US005704149A

United States Patent [19]

Bethshears

[11] Patent Number: 5,704,149

[45] Date of Patent: Jan. 6, 1998

[54] HAMMER FOR MUZZLE LOADER RIFLE

[76] Inventor: David Bethshears, 35 Hillcrest Dr., Bruceton, Tenn. 38317

[21] Appl. No.: 500,807

[22] Filed: Jul. 11, 1995

[51] Int. Cl.[6] ..... F41C 7/00

[52] U.S. Cl. ..... 42/51; 42/44; 42/69.03; 42/70.08; 42/1.04

[58] Field of Search ..... 42/51, 44, 69.03, 42/70.08, 1.04

[56] References Cited

U.S. PATENT DOCUMENTS

| | | | |
|---|---|---|---|
| 15,041 | 6/1856 | Kesling | 42/51 |
| 28,627 | 6/1860 | Lord | 42/83 |
| 131,598 | 9/1872 | Byers | 42/69.01 |
| 308,241 | 5/1884 | De Belleval | 42/69.01 |
| 461,679 | 1/1891 | Henry | 42/45 |
| 468,853 | 1/1892 | Werner | 42/69.01 |
| 469,561 | 9/1892 | Haines | 42/8 |
| 626,310 | 6/1899 | Stapf | 42/69.01 |
| 1,102,026 | 6/1914 | Farnworth | 42/69.01 |
| 1,314,196 | 8/1919 | Johnson et al. . | |
| 1,712,382 | 5/1929 | Driggs, Jr. et al. . | |
| 3,203,128 | 8/1965 | Friend | 42/69 |
| 4,065,867 | 1/1978 | Storey | 42/51 |
| 4,468,877 | 9/1984 | Karyonen | 42/51 |
| 4,503,633 | 3/1985 | Davis | 42/51 |
| 4,625,443 | 12/1986 | Beretta | 42/42.03 |
| 4,672,761 | 6/1987 | Hart | 42/51 |
| 4,888,901 | 12/1989 | French et al. | 42/51 |
| 4,918,849 | 4/1990 | Spota | 42/51 |
| 4,989,357 | 2/1991 | Norman et al. | 42/70.08 |
| 5,274,939 | 1/1994 | Scaramucci et al. | 42/69.02 |
| 5,307,583 | 5/1994 | Mahn et al. | 42/51 |
| 5,421,114 | 6/1995 | Bond et al. | 42/42.03 |
| 5,511,334 | 4/1996 | Ball et al. | 42/51 |

*Primary Examiner*—Charles T. Jordan
*Assistant Examiner*—Meena Chelliah
*Attorney, Agent, or Firm*—Niro, Scavone, Haller & Niro

[57] ABSTRACT

A hammer design for use on various firearms, including specifically muzzle-loading firearms, that is easier to engage, quicker to engage, safer to engage and easily adaptable to handle accessories. The present invention discloses a muzzle loading firearm which includes a stock, a barrel fastened to said stock, a pivot mounted to said stock, a trigger and a hammer mechanism comprising of a hammer head and a lever arm both secured to the pivot.

8 Claims, 2 Drawing Sheets

HAMMER FOR MUZZLE LOADER RIFLE

BACKGROUND OF THE INVENTION

The present invention relates to muzzle-loading firearms and more particularly to the hammer mechanism used in connection with muzzle-loading firearms wherein the hammer strikes a cap or flint to create a spark which ignites the charge contained in the chamber of the barrel of the gun.

Muzzle-loading or black-powder firearms were one of the first stages of development of the modern era firearms. The term "muzzle-loader" refers to the manner the propellant charge and the projectile are loaded into the gun—through the muzzle end of the barrel. Muzzle-loader type guns are loaded by placing a charge, such as black powder, and a projectile into the open discharge or muzzle end of the gun. First, the powder is placed in the barrel followed by a cloth or paper material and then the projectile. The cloth and projectile are tapped down into the bottom of the barrel with a ram-rod. The propellent charge is ignited by creating a fire in the chamber of the barrel of the gun in order to ignite the propellant creating an explosion which propels a projectile through the muzzle end of the barrel. The muzzle-loader type gun provide a single shot before reloading is required.

The muzzle-loader type gun is equipped with an external hammer that is pivotally secured to the stock of the gun. The muzzle-loader type gun was originally of matchlock type construction where a slow-burning match was placed in a hole near the breech end of the muzzle to ignite the propellant charge. Later, Flintlock mechanisms were developed. These mechanisms generally used a hammer for striking a piece of flint to create a spark which in turn ignited the charge that had been placed in the barrel of the gun. The percussion-lock mechanism uses a cap or container holding a small explosive charge which, when struck by the hammer, caused a flame to flow through the flash hole to ignite the charge in the barrel of the gun.

Many people have a current interest in muzzle-loader type guns. Collectors are interested in maintaining muzzle-loader type guns as remnants from the past. Muzzle-loader type guns are also currently used by hunters. In fact, the muzzle-loader segment of hunting has grown substantially in the past several years. There are many states which have special seasons to encourage the use of muzzle-loader type guns. For example, many state wildlife and fishery departments provide extended "black powder" or "muzzle-loader" seasons for hunters desiring to hunt game using these weapons. Because of this new interest, the term "muzzle-loader" has become familiar in the hunting industry.

Traditional muzzle-loader type guns suffer from the disadvantage of having a hammer mechanism that is aligned with the firing pin. Moreover, the spur of the hammer was positioned in close proximity to the hammer head. The typical hammer design for muzzle-loader type firearm can be seen in U.S. Pat. Nos. 15,041 issued to Kesling; 35,783 issued to Seely; 4,989,357 issued to Norman et al.

In each of these designs, the spur or ear of the hammer is positioned in close proximity to the head of the hammer. This configuration creates some severe disadvantages to the operation of the firearm. Prior to firing the weapon, the hammer must be rotated about the pivot to the cocked or engaged position. The internal mechanisms of the pivot comprise of a spring which places a rotational force on the hammer forcing the hammer to strike the firing pin. To cock the hammer, the rotational force created by the spring must be overcome until the hammer is locked in its firing position. The rotation of the hammer is where the problem lies.

The rotational force placed on the hammer is significant. When the spur is positioned near the hammer head, the force required to rotate the hammer to the engaged position is even more amplified. For example, due to the positioning of the spur on the hammer, the force must be applied to the spur in a direction parallel to the barrel of the firearm. Since the firearm is supported by the operator's hands and fingers, most often the rotational force must be applied by the operator's thumb. The human thumb is not made to place the required backward force on the spur.

In the old configuration the thumb had to be placed in an awkward position. This could create a potential danger because when cocking or engaging the hammer mechanism, should the hammer not be fully engaged and then let go, the firearm would discharge accidentally.

The prior art hammer designs are also difficult to disengage once the hammer is engaged. The hammer is spring-loaded, thus it requires a substantial amount of pressure to rotate the hammer and strike the firing pin. The force exerted on the hammer by the spring must be overcome and controlled when releasing the hammer to disengage the firearm. This is a difficult task to perform with the current hammer design, because the uncontrolled release of the hammer may also result in the mis-firing of the firearm.

Additionally, the old hammer designs had no lever arm. Thus, the spur of the hammer mechanism extended above the stock of the weapon. This design created three difficulties: 1) the spur when cocked could hit an object causing accidental discharging of the firearm; 2) the sighting of the weapon prior to firing could be interrupted; and 3) the mounting of a scope on the weapon could be troublesome.

Accordingly, the present invention offers the advantages that it is easier to engage, quicker to engage and safer to engage and fire, because of its unique design.

SUMMARY OF THE INVENTION

The present invention addresses the problems encountered in cocking, disengaging and firing the muzzle-loader type firearms, especially when such firearms are outfitted with modern amenities such as scopes, sites and other such apparatus. The hammer design in the present invention provide the advantage of being easier to engage, quicker to engage, safer to disengage, and easily to permit modern accessories to be mounted to the firearm by using a lever arm in which does not exist in the conventional hammer.

Accordingly, one of the objects of the present invention is to provide a hammer design where it is easier to engage the hammer mechanism. The physical strain on the thumb to cock the hammer with the newly designed hammer is minimal. In fact, with the conventional styled hammer, if one is not careful (because of the awkward position of the thumb and the extreme tension on hammer spring) the gun could accidently be discharged. Most people are right handed, thus, the conventional hammer, usually mounted on the right side of muzzle-loader rifle, makes it very difficult for left handed people to engage. This newly designed hammer is just as easy for a left handed person to use as it is for a right handed person, again a unique property because of the lever arm.

Another object of the present invention provides for quicker engaging of the hammer mechanism. The advantage of the newly designed hammer over the conventional hammer, may be the difference between a successful hunt or an unsuccessful hunt. The hunter may be walking along when a shooting opportunity occurs, by the time he cocked the old conventional hammer design, and prepared to shoot, the shooting opportunity has passed, the game fleeing. With the conventional hammer design, it was difficult to engage the hammer mechanism while sighting a target. That is not the case with the present invention.

Yet another object of the present invention is the hammer mechanism is much safer to disengage. The new design of the hammer makes disengaging the muzzle-loader safer, because it puts the shooter in a less-stressful thumb position, giving more control on the release of the hammer. The hammer is spring loaded, thus, it exerts a substantial amount of pressure that has to be controlled when releasing the hammer to disengage the firearm, again this is a special feature because of the lever arm.

Another advantage of the newly designed hammer is that it has a lower profile by eliminating the spur on top of the hammer. There are two reasons why this advantage is beneficial. First, the lower profile will eliminate the top spur on conventional hammer to hit an object discharging the firearm accidently. Second, the lower profile will make sighting and scope mounting less trouble and more proficient for the "Modern day Muzzle-Loader."

DETAILED DESCRIPTION OF THE PREFERRED EMBODIMENTS

Figure 1:
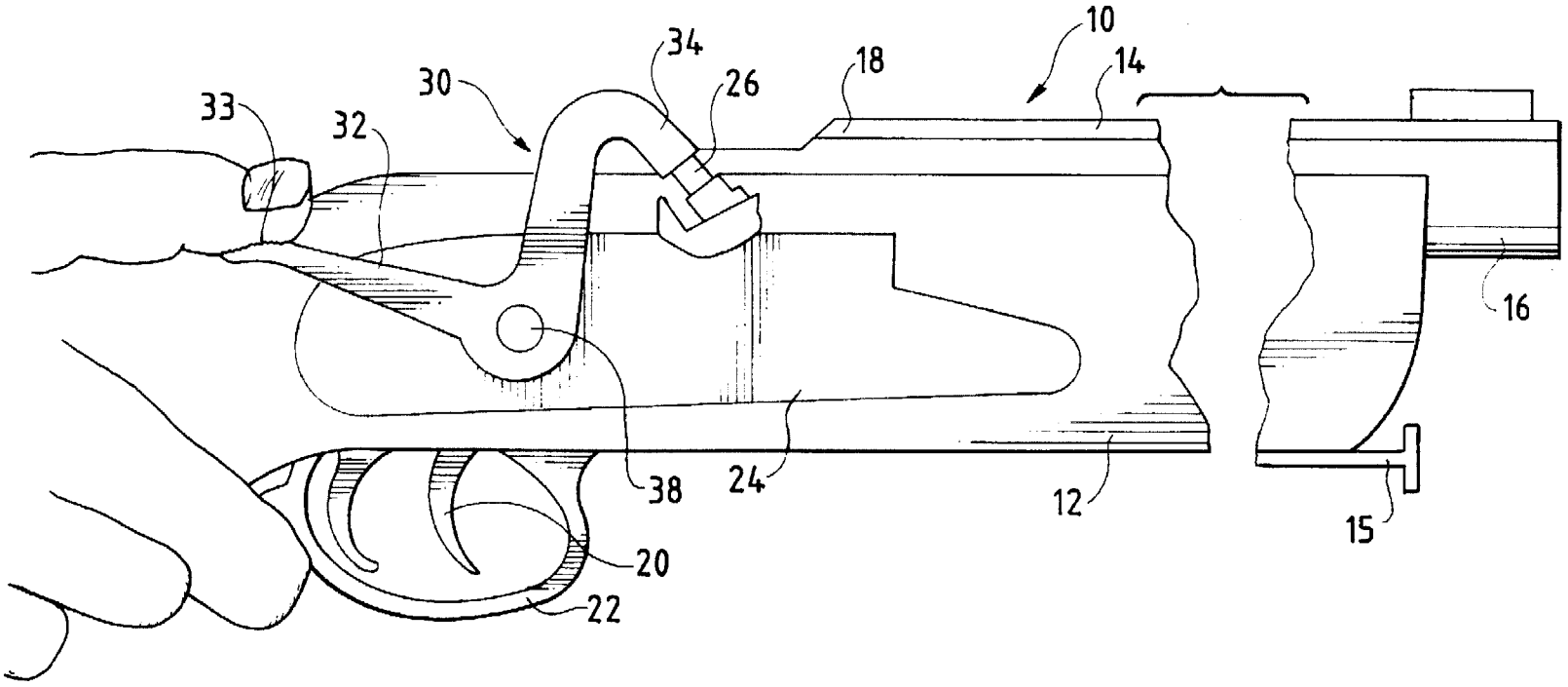
FIG. 1 is a side view of the muzzle loading firearm containing the hammer mechanism of the present invention.

Referring now to the drawings, FIG. 1 shows a perspective view of a muzzle-loader type firearm having the hammer mechanism of the present invention. As shown in FIG. 1, the firearm 10 resembles a conventional muzzle-loader firearm. The firearm includes a stock 12, to which a barrel 14 is attached. The barrel 14 has a discharge or muzzle end 16 and a breech end 18 positioned near the stock 12. The barrel 14 may be connected to the stock 12 by barrel bands or other fastener means, or the barrel may be integral with the stock 12. In this embodiment, the firearm has a trigger 20, trigger guard 22, protective plate 24 and firing pin 26. The hammer mechanism 30 is the essence of the invention.

Figure 2:
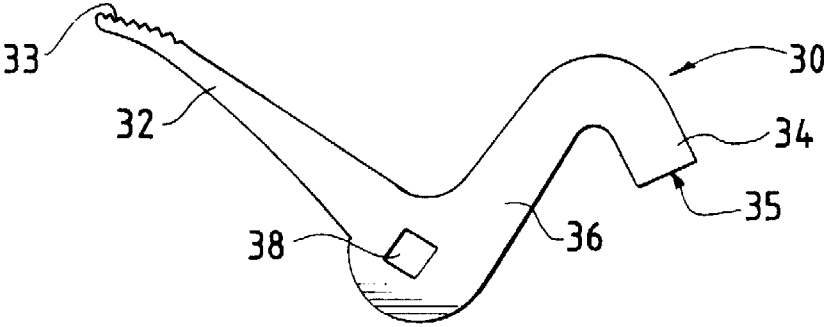
FIG. 2 is a side view of the hammer mechanism.
Figure 3:
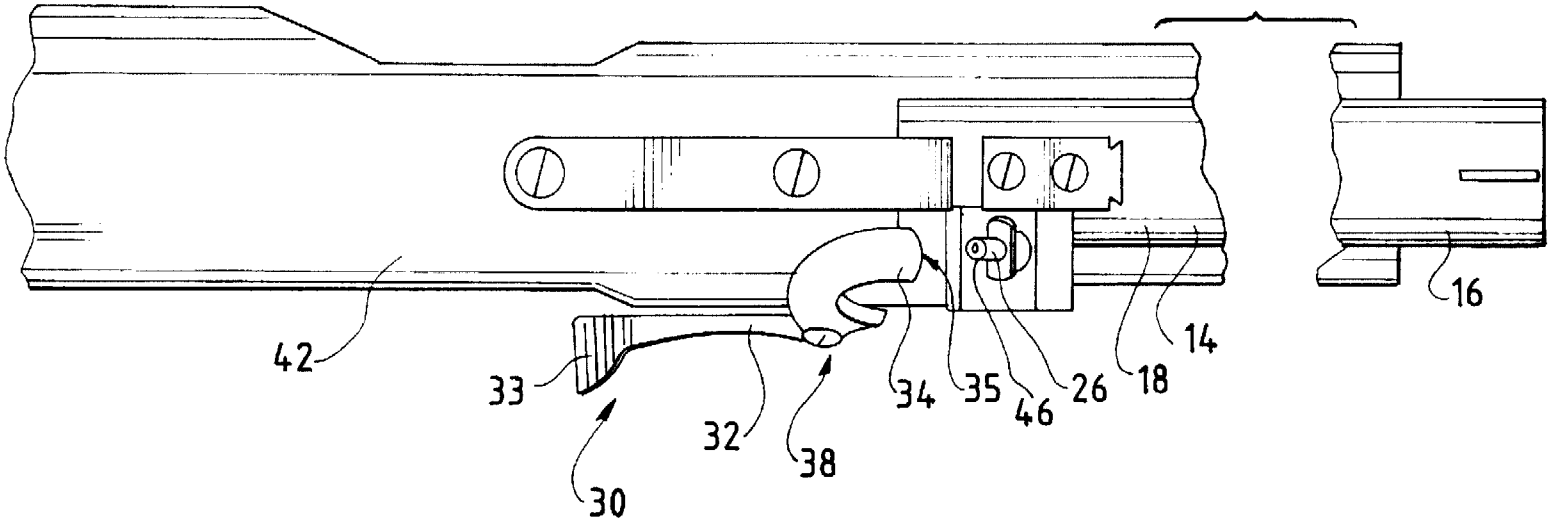
FIG. 3 is a top view of the hammer mechanism in the engaged position.

The hammer mechanism 30 is shown in more detail in FIGS. 2 and 3. The hammer mechanism 30 has a lever arm 32, a hammer head 34, a hammer shaft 36, a striking surface 35, and a pivot connection 38. The present invention does not have a cocking spur located along the hammer shaft. In fact, the conventional hammers have a spur that was joined to the hammer near the hammer head. Thus, in the conventional system, the spur in the disengaged position, would be essentially at a 90° angle with the barrel of the firearm. The lever arm 32 and hammer shaft 36 are joined at the pivot connection 38. By positioning the lever arm 32 such that the lever arm 32 is connected to the hammer shaft 36 about the pivot connection 38, the operator of the firearm has greater control and can exert less of a force to cock the hammer 30. The hammer 30 is generally made of steel metal in mold.

The muzzle-loader rifle is shown in top view in FIG. 3. FIG. 3 shows the top of the buttstock 42, the breech 18, the barrel 14 and the stock 12. Additionally, FIG. 3 shows a top view of the hammer mechanism 30 in the cocked position. The lever arm 32, the hammer head 34, the striking surface 35 and the hammer shaft 36 are all visible. The hammer mechanism is attached to the stock 12 of the gun 10 by means of a pivot connection 38. The pivot connection 38 may be a screw, pin or other suitable means for connecting the hammer 30 to the stock 12. FIG. 3 also discloses the nipple 26. The hammer head 34 is aligned with the nipple 26 such that when the trigger 20 is activated to release the hammer 30, the striking surface 35 of the hammer head 34 strikes the nipple 26. The nipple 26 contains a firing vent 46 that comprises a small opening, or bore, which proceeds into the firing chamber located in the breech 18 of the barrel 14. A percussion cap may be placed on the nipple 26 to create a flash when struck by the striking surface 35 of the hammer head 34. The flash created by the striking surface 35 of the hammer head 34 striking the cap placed on the nipple 26, travels through the firing vent 46 into the chamber at the breech 18 to ignite a charge. The same effect may be created using a flint piece instead of a cap. With the flint type mechanism, the striking surface 35 of the hammer head 34 strikes the flint placed on the nipple 26 to create a spark to ignite the charge.

Prior to firing the gun, the hammer 30 must be rotated about the pivot 38 to the engaged position. Located in the stock 12, behind the plate 24, is a spring and lock mechanism. The spring places a rotational force on the pivot 38 which in turn forces (or rotates) the hammer head 34 and hammer shaft 36 toward the firing pin 26 such that the striking surface 35 of the hammer head 34 strikes the firing pin 26. To engage the hammer 30, the rotational force imputed on the hammer 30 by the spring must be overcome until the hammer 30 is locked in the firing position. The hammer 30 is released when the trigger 20 is pulled by the operator. In the present invention, a downward pressure is applied to the lever arm 32 by the operator to overcome the rotational force applied to the hammer 30. The positioning of the lever arm 32 such that it connects to the hammer shaft 36 about the pivot 38 provides for a downward force to be placed on the lever arm 32.

The lever arm 32 is positioned in such a manner that it does not overlie the stock 12. In the preferred embodiment, the lever arm 32 runs parallel to the side-face of the stock. This allows the operator of the firearm 10 to perform several functions. First, the thumb grip 33 is positioned parallel to the stock 12, which permits the operator to cock the hammer mechanism 30 by placing a force perpendicular to the stock 12. In the old design, the force required to cock the hammer 30 would be in a direction parallel to the barrel 14. Second, as seen in FIG. 1, the lever arm 32 of the hammer 30 cannot extend above the top portion of the stock 12. This protects the hammer 30 such that the lever arm 32 cannot be accidentally bumped to cause the accidental disengagement of the hammer 30, which would cause accidental firing of the weapon. Further, the positioning of the hammer 30 provides for the mounting of a sighting scope on the barrel 14 of the weapon.

To operate the firearm of the present invention, the muzzle end of the barrel 14 is placed in a generally vertical position to accommodate the charge, such as black gun powder, which is placed into the muzzle end of the barrel 14. The powder travels along the barrel 14 into the chamber at the breech end 18 of the barrel 14. Next, a projectile, such as a steel or lead shot is placed into the muzzle of the barrel 14. The ball may be tamped into placed within the barrel by a ram-rod 15 to properly place the ball and charge in the chamber or breech 18 of the barrel 14.

After the gun is loaded, the hammer head 34 is rotated away from the nipple 26 by placing a downward force against the lever arm 32 of the hammer 30, thus, rotating both the hammer head 34 and the lever arm 32 about the pivot connection 38. The lever arm 32 is moved until the hammer 30 is in the "cocked" position such that the hammer 30 cannot be released without activating the trigger 20.

A percussion cap may be placed on the nipple 26. The gun is now ready to fire. To fire the gun, the operator must activate the trigger 20 which, in turn, release the hammer 30 from the "cocked" position. The hammer head 34 rotates about the pivot 38 until the striking surface 35 of the hammer head 34 strikes the percussion cap located on the nipple 26. Striking the percussion cap explodes the cap sending a flash through the firing hole 46 to ignite the charge positioned in the chamber of the barrel 14 which, in turn, propels the projectile through the barrel 14 and out the muzzle end of the barrel 14. During the firing of the rifle, the lever arm 32 does not rotate above the top of the stock 12 or buttstock 42.

While more than one preferred embodiment has been shown in accordance with the present invention, it is understood that the same is not limited thereto, but is susceptible to numerous changes and modifications as known to a person having ordinary skill in the art, and I therefor do not wish to be limited to the details shown and described herein, but intend to cover all such modifications as are encompassed by the scope of the appended claims.

What is claimed is:

1. A muzzle-loading firearm comprising:

a stock;

a barrel fastened to said stock, said barrel having a chamber end and a muzzle end wherein said chamber end has a firing hole;

a nipple affixed to said stock and having a bore in a plug which is aligned with said firing hole;

a pivot connector rotatably mounted to said stock wherein said pivot connector may be rotated to an engaged position or a fired position;

a hammer pivot affixed to said pivot connector;

a hammer head having a generally elongated body and a first and a second end at respective ends of said body, and having a first central axis defined by an imaginary line extending along said body and aligned with both said first and said second ends, wherein said first end is secured to said hammer pivot and said second end contacts said nipple when said pivot connector is in said fired position;

a lever arm having a generally elongated body and a pivot end and a thumb grip end at respective ends of said body, and having a second central axis defined by an imaginary line extending along said body and aligned with both said pivot end and said thumb grip end wherein said pivot end is secured to said hammer pivot and said thumb grip end provides leverage for rotating said hammer pivot between said fired position and said engaged position, whereby said first central axis and said second central axis intersect at said pivot connector;

a trigger for releasing said pivot connector from said engaged position to rotate said hammer head to strike said nipple.

2. The muzzle-loading firearm recited in claim 1, wherein said lever arm is positioned relative to said stock such that the user has an unobstructed view along the length of said barrel.

3. The muzzle-loading firearm recited in claim 1, wherein the lever arm never extends beyond to topmost portion of said stock.

4. The muzzle-loading firearm recited in claim 3, wherein said pivot is rotated to said engaged position by placing a majority of the force on the lever arm in a direction perpendicular to said barrel.

5. The muzzle loading firearm recited in claim 1, wherein the forces placed on the lever arm are in both a direction perpendicular to said barrel and forward toward said nipple.

6. The muzzle loading firearm recited in claim 5, wherein said hammer head, said hammer pivot and said lever arm form a V-shape.

7. The muzzle loading firearm recited in claim 6 wherein the angle formed by said hammer head, said pivot connector and said lever arm is about 90°.

8. The muzzle loading firearm recited in claim 6 wherein the angle formed by said hammer head, said pivot connector and said lever arm is at least 90°.

* * * * *